US010415345B2

(12) United States Patent
Yue et al.

(10) Patent No.: US 10,415,345 B2
(45) Date of Patent: Sep. 17, 2019

(54) MILLABLE BRIDGE PLUG SYSTEM

(71) Applicant: CNPC USA Corp., Houston, TX (US)

(72) Inventors: Jianpeng Yue, Sugar Land, TX (US); Marvin Allen Gregory, Spring, TX (US); Xiangtong Yang, Xinjiang (CN); Hongtao Liu, Xinjiang (CN)

(73) Assignee: CNPC USA CORPORATION, Houston, TX (US)

( * ) Notice: Subject to any disclaimer, the term of this patent is extended or adjusted under 35 U.S.C. 154(b) by 156 days.

(21) Appl. No.: 15/388,787

(22) Filed: Dec. 22, 2016

(65) Prior Publication Data

US 2018/0179853 A1 Jun. 28, 2018

(51) Int. Cl.

| | |
|---|---|
| ***E21B 33/134*** | (2006.01) |
| ***E21B 33/128*** | (2006.01) |
| ***E21B 33/129*** | (2006.01) |
| ***E21B 29/00*** | (2006.01) |

(52) U.S. Cl.

CPC ..... *E21B 33/134* (2013.01); *E21B 29/00* (2013.01); *E21B 33/128* (2013.01); *E21B 33/1293* (2013.01)

(58) Field of Classification Search

CPC ..... E21B 33/134

See application file for complete search history.

(56) References Cited

U.S. PATENT DOCUMENTS

| | | | | |
|---|---|---|---|---|
| 3,049,177 | A | 8/1962 | Bonner | |
| 3,374,841 | A | 3/1968 | Current | |
| 3,526,277 | A | 1/1970 | Scott | |
| 4,862,961 | A | 9/1989 | Neff | |
| 6,241,023 | B1 | 6/2001 | Krauss et al. | |
| 6,796,376 | B2 | 9/2004 | Frazier | |
| 7,143,832 | B2 | 12/2006 | Fyer | |
| 7,387,158 | B2 | 6/2008 | Murray et al. | |
| 7,401,788 | B2 | 7/2008 | Williams et al. | |
| 7,789,136 | B2 | 9/2010 | Turley et al. | |
| 7,810,558 | B2 | 10/2010 | Shkurti et al. | |
| 8,047,280 | B2 | 11/2011 | Tran et al. | |
| 8,066,065 | B2 | 11/2011 | Buckner | |
| 2004/0003928 | A1* | 1/2004 | Frazier | E21B 33/1204 166/387 |
| 2010/0181729 | A1 | 7/2010 | Slay et al. | |

* cited by examiner

*Primary Examiner* — D. Andrews

(74) *Attorney, Agent, or Firm* — Craft Chu PLLC; Andrew W. Chu

(57) ABSTRACT

A millable bridge plug system includes a mandrel having an upper portion and a lower portion with an interlock, a shearing member attached at the upper portion, a sealing member, ring members, cone assemblies, slip devices, and an interlocking drill member at a lower portion of the mandrel. The interlock of the mandrel and the interlocking drill member are modular so that one bridge plug interchangeably connects to another bridge plug. The interlocks are compatible with interlocking drill members of other bridge plugs and vice versa. The interlocking drill member has rotatable cutting blades to drill through sand and other debris between the interlocking drill member and the next bridge plug to be removed. A milling unit can drive rotation of the interlocking drill member to reach the next bridge plug for removal, until the interlocking drill member engages the adjacent interlock of the next bridge plug to be removed.

10 Claims, 4 Drawing Sheets

MILLABLE BRIDGE PLUG SYSTEM

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a downhole tool for isolating zones in a wellbore. More particularly, the present invention relates to a millable bridge plug system.

2. Description of Related Art Including Information Disclosed Under 37 CFR 1.97 and 37 CFR 1.98

A bridge plug is a downhole tool that is lowered into a wellbore. At a particular distance through the wellbore, the bridge plug is activated. The bridge plug opens and locks to seal the bridge plug to the walls of the wellbore. The bridge plug separates the wellbore into two sides. The upper portion can be cemented and tested, separate from the sealed lower portion of the wellbore. Sometimes the bridge plugs are permanent, and they seal an entire portion of the wellbore. Other times, the bridge plugs must be removed, and still other times, the bridge plugs must be removed and retrieved. These removable bridge plugs are millable or drillable, so that a drill string can grind through the bridge plug, making remnants of the destroyed bridge plug to remain at the bottom of a wellbore or to be retrieved to the surface by drilling mud flow.

Bridge plugs generally include a mandrel, a sealing member placed around the mandrel, ring members adjacent the end of the sealing member and around the mandrel, upper and lower slip devices at opposite ends of the mandrel, and respective upper and lower cone assemblies engaged to the upper and lower slip devices. FIG. 1A shows the prior art bridge plug system 10 with a mandrel 12, sealing member 14, and upper and lower slip devices 16 and 18 shown. The bridge plug is placed in the wellbore by a setting tool on a positioning assembly, such as wireline, coiled tubing or even the drill string itself. Once in position at the correct depth and orientation, the bridge plug is activated. The setting tool holds the mandrel 12 in place, while a ramming portion of the setting tool exerts pressure on the stack, which includes the sealing member 14 and the slip devices 16 and 18. The end 22 has a cap which prevents the stack from sliding off the mandrel 12, when the ramming portion of the setting tool hits the stack. Instead, the pressure of the ramming portion compresses the stack, forcing the sealing member 14 to radially extend outward to seal against the wellbore or case and to flatten to a smaller height along the mandrel. The slip devices 16 are toothed and are distended radially outward by the stack to dig into the wellbore walls, locking the sealed configuration of the stack. The lower slip device 18 holds position by the cap at the end 22, while the upper slip device 16 lowers and locks the seal of the spread sealing member 14. When the ramming portion has compressed and locked the stack, the end 20 proximal to the setting tool on the positioning assembly is sheared, separating the bridge plug from the setting tool and the positioning assembly. FIG. 1B shows the prior art bridge plug system 10 in an activated and set state. Pressure on the lower cone assembly against the lower slip device 18 at the distal end of the mandrel causes the lower slip device 16 to open and latch against the wellbore. Continuing pressure by the ram expands the sealing member 14 against the rings to form a seal against the walls of the wellbore. Pressure on the upper cone assembly causes the upper slip device 18 to also open and latch against the wellbore, setting the seal of the sealing member.

Conventional materials of the millable bridge plug, like all downhole tools, must withstand the range of wellbore conditions, including high temperatures and/or high pressures. High temperatures are generally defined as downhole temperatures generally in the range of 200-450 degrees F.; and high pressures are generally defined as downhole pressures in the range of 7,500-15,000 psi. Other conditions include pH environments, generally ranging from less than 6.0 or more than 8.0. Conventional sealing elements have evolved to withstand these wellbore conditions so as to maintain effective seals and resist degradation.

Metallic components have the durability to withstand the wellbore conditions, including high temperatures and high pressures. However, these metallic components are difficult to remove. De-activating and retrieving the bridge plug to the surface is costly and complicated. Milling metallic components takes time, and there is a substantial risk of requiring multiple drilling elements due to the metallic components wearing or damaging a drilling element of a removal assembly.

Non-metallic components are substituted for metallic components as often as possible to avoid having so much metal to be milled for removal of the bridge plug. However, these non-metallic components still must effectively seal an annulus at high temperatures and high pressures. Composite materials are known to be used to make non-metallic components of the bridge plug. These composite materials combine constituent materials to form a composite material with physical properties of each composite material. For example, a polymer or epoxy can be reinforced by a continuous fiber such as glass, carbon, or aramid. The polymer is easily millable and withstands the wellbore conditions, while the fibers also withstand the wellbore conditions and resist degradation. Resin-coated glass is another known composite material with downhole tool applications. Composite materials have different constituent materials and different ways of combining constituent materials.

A problem of the conventional bridge plug is the debris and sand between bridge plugs during removal of multiple bridge plugs. A removal assembly, such as a milling unit on a drill string or other wireline device, has a milling or drilling element to drill through components of the bridge plug. As the milling unit destroys the slip device 16, the mandrel 12, the sealing member 14, and the other slip device 18, some remnants fall further into the wellbore. Also, there is sand and other debris between the milling unit and the next bridge plug to be removed. The sand, remnants, and debris hinder movement of the milling unit through the wellbore, and the milling unit does not have cutters for drilling through sand and debris. The milling unit with cutting elements for the composite materials and metallic components of a bridge plug are not effective at drilling sand and other debris from rock formations. The sand and other debris can also damage the milling unit, which lacks the specialized cutters for rock formations of a conventional drill bit. There is a need to remove the non-bridge plug materials between bridge plugs during the overall removal process.

It is an object of the present invention to provide an embodiment of the millable bridge plug system with a drilling end.

It is another object of the present invention to provide an embodiment of the millable bridge plug system with an interlocking drill end.

It is still another object of the present invention to provide an embodiment of the millable bridge plug system with a drilling end with a locking connection to an adjacent bridge plug.

It is yet another object of the present invention to provide an embodiment of the millable bridge plug system with a drilling end for sand and other debris between the drilling end and an adjacent bridge plug to be removed.

These and other objectives and advantages of the present invention will become apparent from a reading of the attached specifications and appended claims.

BRIEF SUMMARY OF THE INVENTION

A millable bridge plug system comprises a mandrel having an upper portion and a lower portion, a shearing means attached at the upper portion of the mandrel, an interlocking means between the shearing means and the lower portion, a sealing means positioned around the mandrel between the upper portion and the lower portion, a plurality of ring members, a plurality of cone assemblies, a plurality of slip means for extending radially outward and engaging an inner surface of a surrounding borehole, and an interlocking drill means attached at the lower portion of the mandrel. A first ring member is placed adjacent the upper end of the sealing means, and a second ring member is adjacent the lower end of the sealing means. A first cone assembly is proximate to the first ring member, and a second cone assembly is proximate to the second ring member. The slip means extend radially outward and engage an inner surface of a surrounding borehole to lock the position of the bridge plug. A first slip means is mounted around the mandrel and engages the first cone assembly, and a second slip means is mounted around the mandrel and engages the second cone assembly.

The bridge plug system is modular so that the bridge plugs are interchangeable and compatible with connecting to each other end to end. The interlocking means on the upper portion of the mandrel and the interlocking drill means on the lower portion of the mandrel can engage complementary components on adjacent bridge plugs. The shearing means has a shaft member and a shearing groove so that at least a portion of the shearing groove and interlocking means remain on the upper portion of the mandrel, after setting the bridge plug and removal of the upper end of the shearing means. The interlocking drill means is comprised of a tubular body with a fastening means on one end and a drilling means on an opposite end. In one embodiment, the fastening means is a toothed ring with protrusions to engage components rotating by a milling unit. Remnants of the second slip means or a milling surface of the actual milling unit can engage the toothed ring to rotate the tubular body. On the other end, the drilling means is comprised of cutting blades around a perimeter of the tubular body. As the milling unit rotates components to engage the fastening means, the cutting blades are rotated to drill through sand and debris between the tubular body and the next bridge plug to be removed. Once aligned, the corresponding mandrel of the next bridge plug is centered on an inner cavity between the cutting blades and guided into an inner chamber of the tubular body. The interlocking means on the corresponding mandrel fits into the inner cavity of the interlocking drill means to lock the cutting blades relative to the corresponding mandrel. The rotation is stopped, and the interlocking drill means is not longer cutting through sand and debris between bridge plug systems. The interlocking drill means and interlocking means are modular, such that the interlocking drill means of one bridge plug can lock to any interlocking means on the corresponding mandrel of another bridge plug, and the interlocking means of one bridge plug can lock into an inner cavity of any interlocking drill means of another bridge plug. Once connected to the next bridge plug, the milling unit can destroy the interlocking drill means locked onto the next mandrel. The interlocking means of the next bridge plug prevents movement of the interlocking drill means so that the milling unit can trap and mill through the interlocking drill means against the next bridge plug. The process can be repeated with the next interlocking drill means and a corresponding interlocking means of the next bridge plug.

The method of connecting two bridge plugs includes aligning a primary bridge plug and a secondary bridge plug, the secondary bridge plug being positioned below the primary bridge plug. The primary bridge plug comprises a primary mandrel having an upper portion and a lower portion, a primary shearing means attached at the upper portion of the primary mandrel, a primary interlocking means between the primary shearing means and the lower portion of the primary mandrel, and a primary interlocking drill means attached at the lower portion of the primary mandrel. The secondary bridge plug comprises a secondary mandrel having an upper portion and a lower portion, a secondary shearing means attached at the upper portion of the secondary mandrel, a secondary interlocking means between the secondary shearing means and the lower portion of the secondary mandrel, and a secondary interlocking drill means attached at the lower portion of the secondary mandrel. The method further includes rotating the primary interlocking drill means when at least a portion of the primary bridge plug moves toward the secondary bridge plug. The rotating primary interlocking drill means drills through sand, pieces of the primary bridge plug and other debris in order to reach the secondary bridge plug. Then, the method includes inserting the secondary interlocking means into the primary interlocking drill means. The primary interlocking drill means locks to the secondary interlocking means to stop rotation of the primary interlocking drill means and to hold the bridge plugs together. The rest of the primary bridge plug can be milled as held in place by the secondary bridge plug. The structures are modular and interchangeable with other respective bridge plug parts so that the secondary bridge plug can be milled, and the secondary interlocking drill means can drill towards another bridge plug for removal.

DETAILED DESCRIPTION OF THE INVENTION

Figure 1A:
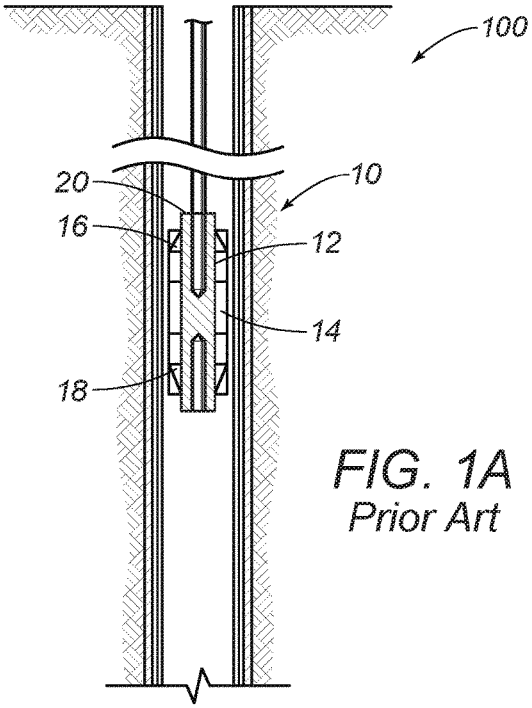
FIG. 1A Prior Art
FIG. 1A is a schematic view of a prior art bridge plug system, being placed in a wellbore.
Figure 1B:
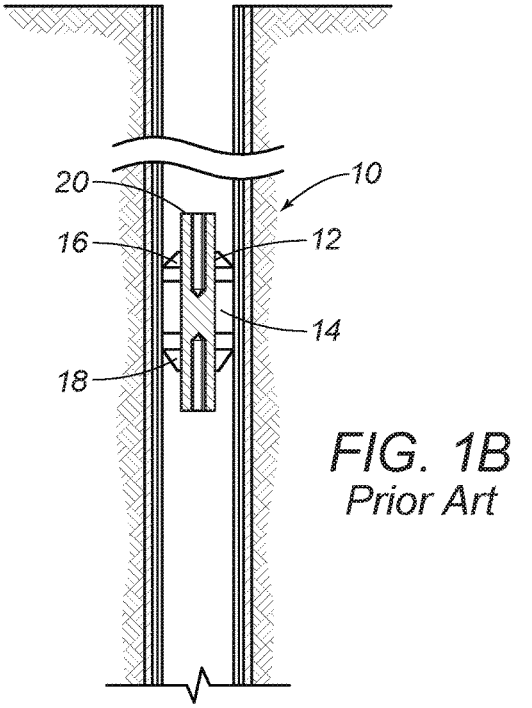
FIG. 1B Prior Art
FIG. 1B is another schematic view of the prior art bridge plug system, being locked in position within the wellbore.
Figure 2:
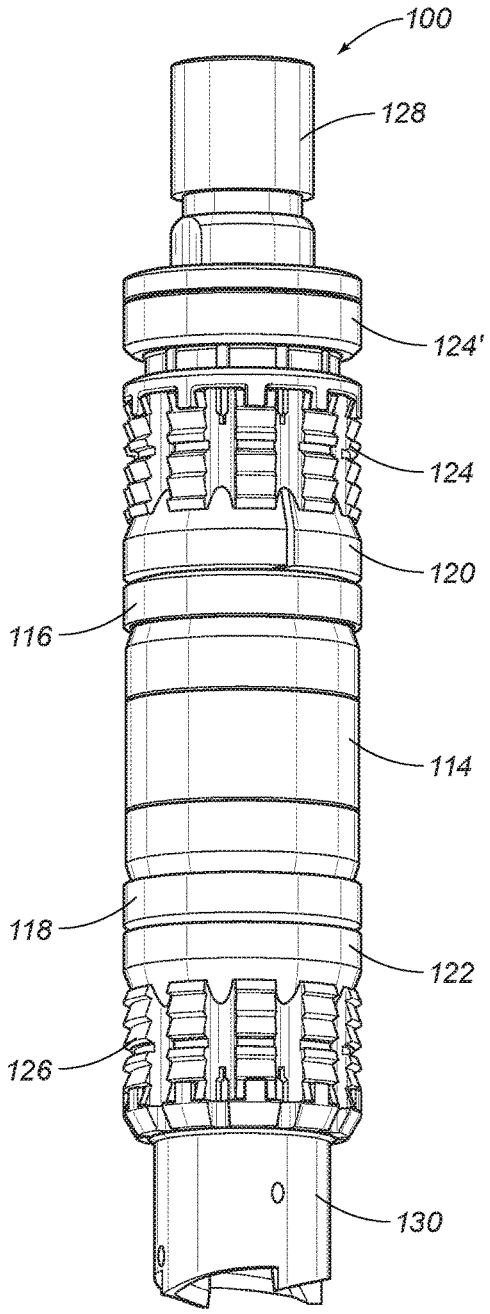
FIG. 2 is a perspective view of an embodiment of the bridge plug of the present invention.
Figure 3:
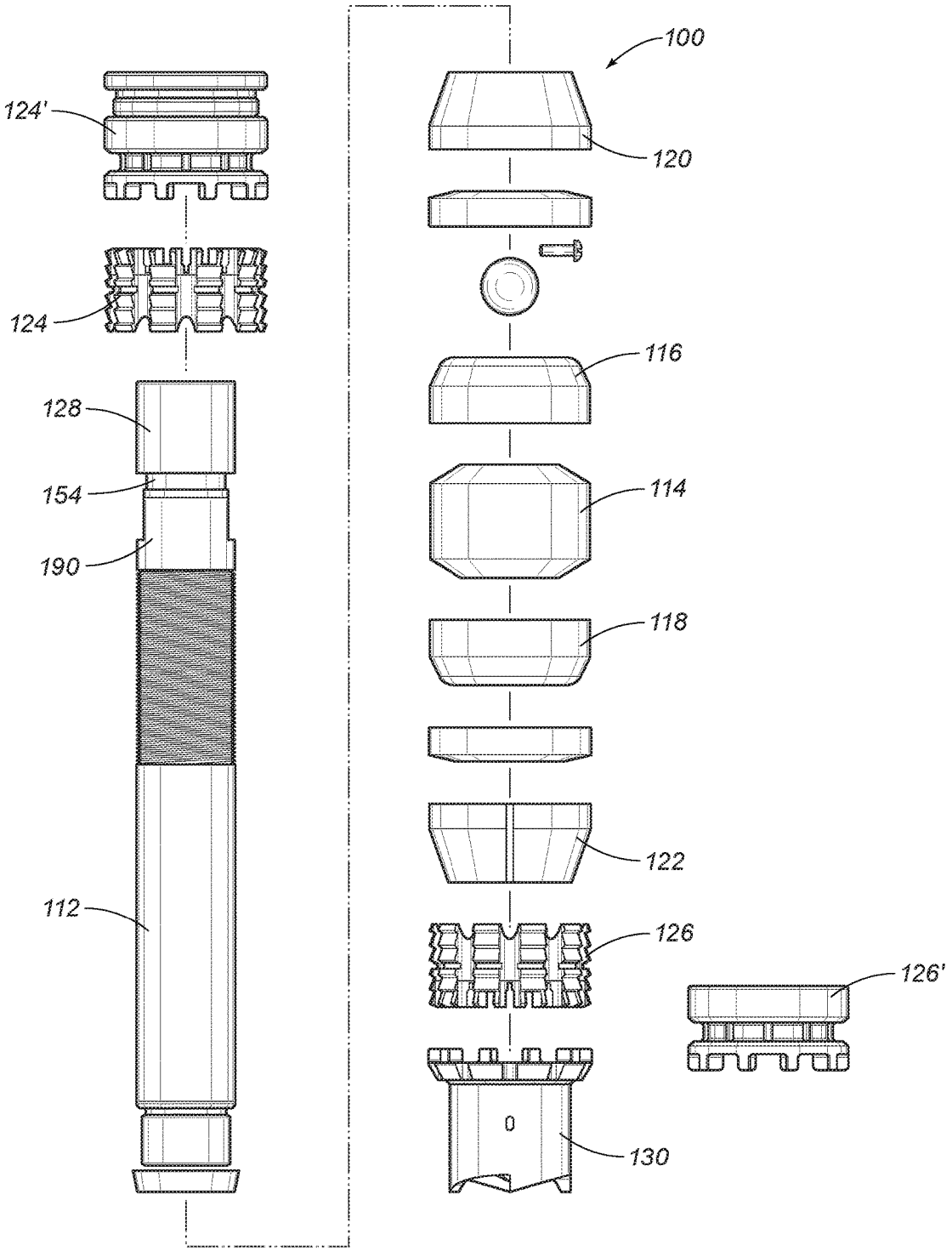
FIG. 3 is an exploded perspective view of the embodiment of FIG. 2.
Figure 4:
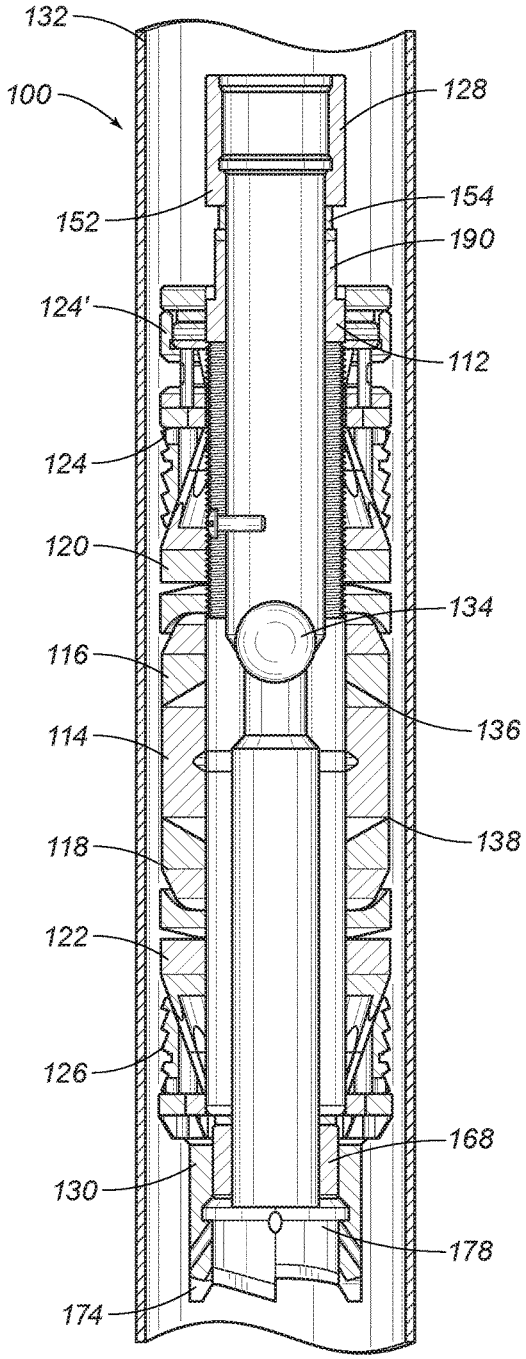
FIG. 4 is a cross-sectional view of an embodiment of the bridge plug of the present invention along an axis of the bridge plug, showing placement in the wellbore.

Referring to FIGS. 2-5, an embodiment of the millable bridge plug system 100 of the present invention is shown. The system 100 includes a mandrel 112, a sealing means 114, and a plurality of ring members, 116, 118, a plurality of cone assemblies 120, 122, and a plurality of slip means 124, 126. The sealing means 114, ring members 116, 118, cone assemblies 120, 122 and the slip means 124, 126 are stack structures mounted on the mandrel 112, sharing a common radial axis of alignment. FIGS. 3 and 4 also show the mandrel 112 with a ball valve, including an illustration of a ball and a pin for controlling the ball valve. FIGS. 2-5 also show a shearing means 128, interlocking means 190 and an interlocking drill means 130. There are also mounting rings 124', 126' for respective slip means 124, 126. The millable bridge plug system 100 is placed within a wellbore or borehole of a well by a setting tool. The wellbore or the borehole could have a casing or not, and the orientation of the wellbore is variable. FIG. 4 shows an embodiment with a casing 132. The bridge plug system 100 can be used in all ranges from generally vertical to generally horizontal orientations. As previously described, the millable bridge plug system 100 is used to isolate zones within the wellbore, separating sections of the wellbore for production or isolation. The system 100 is millable or drillable, such that a removal assembly, such as a milling unit on a drill string, can be used to grind through the system 100. All of the components of the system 100 are destroyed so that the isolated zone of the wellbore is no longer isolated.

There is typically more than one bridge plug in a wellbore, as more than one zone can be isolated along the length of the wellbore. During removal, the milling unit will need to remove more than one bridge plug, and the order of removal is based on the order of placement at different wellbore depths. The bridge plugs may be spaced apart from each other along the wellbore. Some may be adjacent, and others may be very far apart. The wellbore is not completely empty, especially after the production operations. There can be sand, rocks, chemicals, broken components from other downhole tools, and other debris created by the operation of the well. These materials separate the bridge plugs, and the milling unit must be able to reach each bridge plug through these materials. However, a milling unit for grinding composite and metallic components, such as soft metals like aluminum, is not suited for drilling sand and rocks. The special cutters and drill bit surfaces for drilling through rock to form the wellbore are not present in a milling unit to remove the engineered components of a bridge plug. The present invention addresses movement of the milling unit through the wellbore to reach the next bridge plug through the sand and debris.

Figure 5:
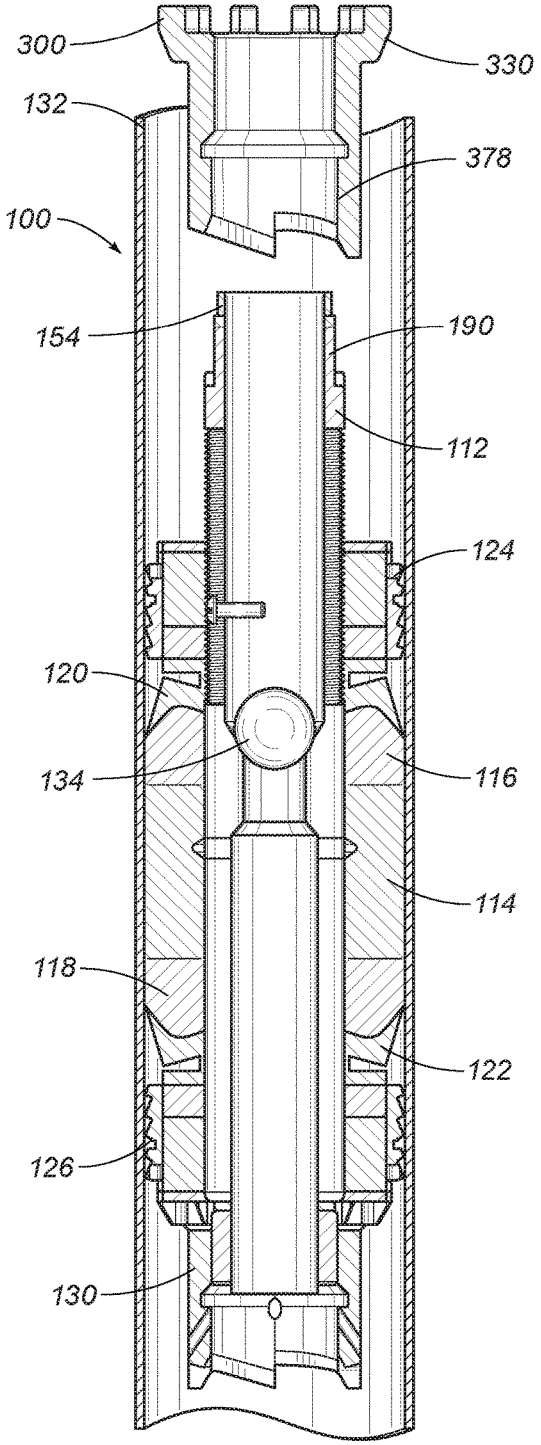
FIG. 5 is a cross-sectional view of an embodiment of the bridge plug of the present invention along an axis of the bridge plug, showing an activated configuration in the wellbore.

Embodiments include the mandrel 112 of the system 100 as a generally tubular member formed of a material to withstand the heat and pressure of the borehole conditions. The mandrel 112 is also millable. The mandrel 112 may have a bridge or ball valve 134, which seals the zone above the system 100 from the zone below the system 100. FIGS. 3-5 show the embodiment with a ball, ball valve and a pin. A sealed bridge is also an embodiment. The sealing means 114 is positioned around the mandrel 112. The sealing means 114 has an upper end 136 and lower end 138 as shown in FIGS. 4 and 5. The sealing means 114 is generally symmetrical to start and is comprised of a deformable material.

FIGS. 2-5 also show the plurality of ring members, 116, 118. There is a first ring member 116 adjacent the upper end 136 of the sealing means 114 and a second ring member 118 adjacent the lower end 138 of the sealing means 114. The ring members 116, 118 surround the sealing means 114 and surround the mandrel 112. The ring members 116, 118 contact the sealing means 114 and can exert pressure on the sealing means 114. In an activated state, the system 100 has the sealing means 114 compressed to radially extend to contact the wellbore or casing 132. The ring members 116, 118 directly contact the sealing means 114. The seal created by the sealing means 114 isolates the zones on the wellbore. In combination with the bridge 130 in the mandrel 112, the wellbore is separated into zones.

The system 100 also includes the plurality of cone assemblies, 120, 122. FIGS. 2-5 show a first cone assembly 120 proximate to the first ring member 116 and a second cone assembly 122 proximate to the second ring member 118. As shown in exploded view of FIG. 3, the first ring member 116 is mounted on the mandrel 112 between the first cone assembly 120 and the sealing means 114. Similarly, the second ring member 118 is mounted on the mandrel 112 between the second cone assembly 122 and the sealing means 114. The cone assemblies 120, 122 contact the ring members 116, 118 and can exert pressure on the ring members 116, 18. In an activated state, the system 100 has pressure of the cone assemblies 120, 122 pushing through the ring members 116, 118 to the sealing means 114.

FIGS. 2-5 also show the plurality of slip means 124, 126 for extending radially outward and engaging an inner surface of a surrounding borehole. The slip means 124, 126 lock the position of the system 100 by fixedly engaging the casing 132 or other structure on the inner surface of the borehole. The slips dig into the casing 132 to anchor the millable bridge plug system 100. Pressure can be exerted on the system 100 to create the seal with the sealing means 114, once the slip means 124, 126 are active. There is a first slip means 124 mounted around the mandrel 112 and engaging the first cone assembly 120 and a second slip means 126 mounted around the mandrel 112 and engaging the second cone assembly 122. FIGS. 2-5 further show mounting rings 124', 126' around respective slip means 124, 126. The mounting rings 124', 126' support the slip means 124, 126, relative to the mandrel 112. The interlocking drill means 130 is attached to the lower portion of the mandrel 112. The interlocking drill means 130 can be engaged to the respective mounting ring 126' of the second slip means 126.

Figure 6:
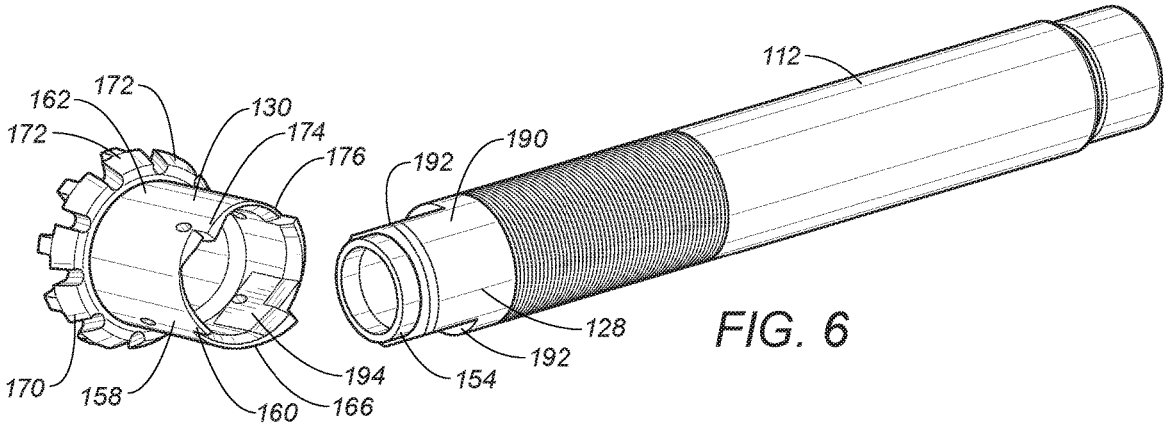
FIG. 6 is a perspective view of a shearing groove and an interlocking means on a mandrel and an interlocking drill means of an embodiment of a bridge plug of the present invention.

FIG. 6 shows a detailed perspective view of the shearing means 128, interlocking means 190, and the interlocking drill means 130 of an embodiment of the millable bridge plug system 100. The shearing means 128 is attached to an upper portion of the mandrel 112 in FIGS. 2-5. The positioning assembly with the setting tool handles the system 100 by the mandrel 112 for placement in the wellbore. The pressure from the ramming portion of the setting tool sets and locks the bridge plug system 100. When the correct location is reached and the wellbore is sealed, the shearing means 128 is separated from the setting tool on the positioning assembly. The setting tool shears the shaft member 152 to break the bridge plug system 100 from the positioning assembly. FIG. 6 shows the remnants of the shearing means 128, after the shearing means 128 has been sheared, when the bridge plug system 100 has been set. FIG. 6 shows the mandrel 112 with the upper end of the shearing means 128 removed. The shearing groove 154 and the interlocking means 190 on the lower end of the shearing means 128 remain. The shearing groove 154 has a diameter smaller than the shaft member 152 of the shearing means 128. The shearing means 128 is formed by a millable material so that the system 100 can be removed.

FIG. 6 also shows an embodiment of the interlocking drill means 130 with a tubular body 158 having a forward end 160 and a back end 162. The forward end 160 faces down the wellbore toward the next bridge plug to be removed. The back end 162 faces up at the other components of the bridge plug system 100, such as the mandrel 112 and the second slip means 126 and respective mounting ring 126'. There is a fastening means 164 on the back end 162 and a drilling means 166 on the forward end 160. The tubular body 158 has an inner chamber 168 adjacent to the back end 162.

FIGS. 2-3 and 6-8 show the fastening means 164 as a toothed ring 170 having at least two protrusions 172 extending radially outward. The protrusions 172 extend toward the second slip means 126 and respective mounting ring 126'. The toothed ring 170 engages components rotated by the milling unit during removal of the bridge plug system 100. Those components may be parts of the bridge plug system 100, such as the second slip means 126, the respective mounting ring 126', a complementary toothed surface of the respective mounting ring 126' as in FIGS. 2-5, or other partially milled pieces of the bridge plug system 100, when the milling unit has not completely milled the interlocking drill means 130. The remnants and pieces can still engage the toothed ring 170 in order to impart torque and rotation to the interlocking drill means 130. Those components may also be the milling unit or at least a milling surface of the milling unit. If all remnants are milled and removed, then the milling unit is able to engage the toothed ring 170 in order to rotate the interlocking drill means 130 directly.

The rotation by the toothed ring 170 of the fastening means 164 also rotates the drilling means 166. The embodiments of FIGS. 2-3 and 6-8 show the drilling means 166 comprised of a plurality of cutting blades 174 around a perimeter 176 of the forward end 160. The cutting blades 174 faces toward the next bridge plug to be removed and away from the mandrel 112, or at least the original relative position of the mandrel 112 before the milling unit destroyed the mandrel 112. The cutting blades 174 are distributing along the perimeter 176 and can be placed at regular intervals. The drilling means 166 also includes an inner cavity 178 formed by the cutting blades 174 and a transition zone 180 between the inner cavity 178 and the inner chamber 168. The inner cavity 178 is generally cylindrical and complementary in shape to an interlocking means of any adjacent bridge plug system, which is analogous to the interlocking means 190. The transition zone 180 is generally conical with a diameter narrowing from the diameter of the inner cavity 178 to the diameter of the inner chamber 168. The transition zone 180 guides the next bridge plug. When the interlocking drill means 130 cuts through the sand and debris to reach the next set bridge plug, the sheared shaft member of the next bridge plug. Analogous to the shearing groove 154 and interlocking means 190 remaining on the sheared bridge plug system 100, the shearing groove of the next bridge plug inserts through the inner cavity 178, and the transition zone 180 guides that shearing groove of the next bridge plug to the inner chamber 168 of the interlocking drill means 130. Analogous to the interlocking means 190, the interlocking means of the next bridge plug fits into the inner cavity 178 to stop the rotation of the interlocking drill means 30. The remnants of the shearing means, such as the shearing groove are housed in the inner chamber 168, and the interlocking means fit into the inner cavity 178.

Figure 7:
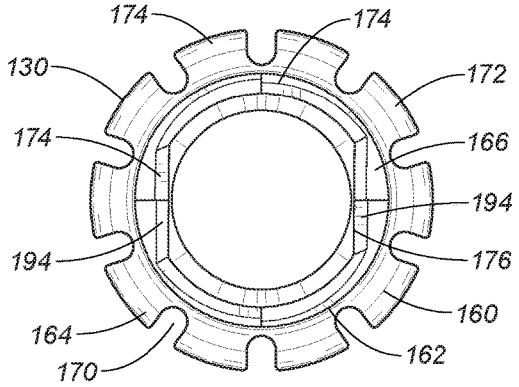
FIG. 7 is an end view of a forward end of the interlocking drill means means of the embodiment of FIG. 6.
Figure 8:
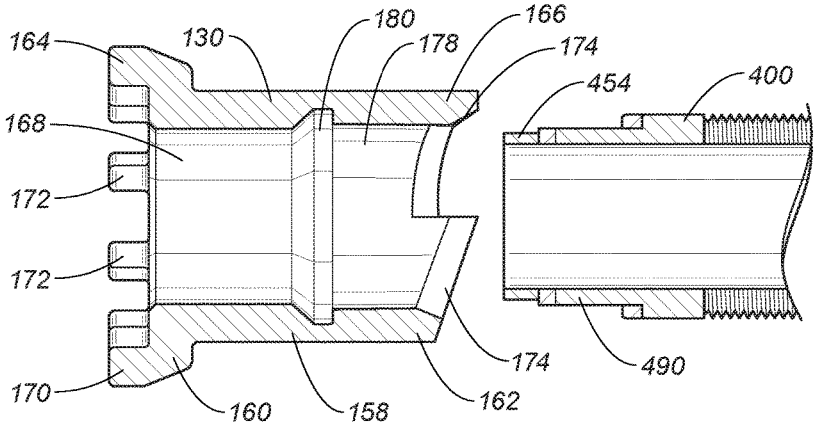
FIG. 8 is a cross-sectional view of the interlocking drill means of the embodiment of FIG. 6.

FIGS. 6-8 show embodiments of the interlocking means 190 as flattened outer surfaces 192 on opposite sides of the mandrel 122 and the inner chamber 178 with complementary flattened inner surfaces 194 on opposite sides of the drilling means 166. The interlocking means 190 friction fit to an adjacent inner chamber of an adjacent bridge plug system above the interlocking means 190 so as to lock rotation of that adjacent inner chamber relative to the interlocking means 190. After the bridge plug system 100 is milled and the interlocking drill means 130 is drilling toward the next bridge plug, the inner chamber 178 is friction fit to an adjacent interlocking means of the next bridge plug system below the inner chamber 178 so as to lock rotation of the interlocking drill means 130 relative to that next bridge plug. When there is a remnant of the shearing means 128, after the bridge plug system 100 has been set and sheared, that remnant, such as a portion of the shearing groove 154 can be housed in the inner cavity of the bridge plug system above the shearing groove 154. Similarly, the inner cavity 168 of the bridge plug system can contain the sheared remnant of the shearing means of the bridge plug system below the interlocking drill means 130.

There are other embodiments of the interlocking means 190 and the interlocking drill means 130. In particular, the interlocking means 190 can have a locking shoulder, such as a slot or groove and the inner cavity 178 can have a complementary protrusion to fit that slot or groove. The locking shoulders between the protrusion and slot or groove can stop rotation of the interlocking drill means 130. The interlocking means and interlocking drill means can include other components to mechanically lock the cutting blades relative to the mandrel of the next bridge plug system.

Once locked in place, the interlocking drill means 130 no longer rotates. The cutting blades 174 for sand and rocks are not effective against the composite material and metallic components of the next bridge plug. The milling unit traps the interlocking drill means 130 against the next bridge plug so that the interlocking drill means 130 is milled for complete removal of the bridge plug system 100.

The interlocking drill means 130 and the interlocking means 190 are modular ends of the bridge plug system 100. In FIG. 5, an adjacent interlocking drill means 330 of an adjacent bridge plug 300 above the bridge plug 100 is insertable over the shearing groove 154 so as to lock the adjacent bridge plug 300 to the interlocking means 190. The shearing groove 154 is fit within the adjacent inner chamber 378. The interlocking means 190 is friction fit to the adjacent inner chamber 378 of the adjacent bridge plug system 300 so as to look rotation of the adjacent bridge plug system 300 relative to the interlocking means 190 and to house the shearing groove 154 within the adjacent inner chamber 378. In FIG. 8, is also follows that the interlocking drill means 130 can be inserted over another adjecent shaft groove 454 of an another adjacent bridge plug 400 below the bridge plug 100, so as to lock the another adjacent bridge plug 400 to the interlocking drill means 130.

The interlocking drill means 130 includes the fastening means 164 to engage components rotated by the milling unit; and the inner cavity 178 holds another adjacent bridge plug 400 to the interlocking drill means 130 in FIG. 8. The inner chamber 178 is friction fit to an adjacent interlocking means 490 of the adjacent bridge plug system 400 below the inner chamber 178 so as to lock rotation of the interlocking drill means 130 relative to the adjacent bridge plug system 400. The inner chamber 178 fits another adjacent shearing groove 454 of the another adjacent bridge plug system 400 within the inner chamber 178. The inner cavity 178 improves the consistency and strength of the connection between bridge plugs. The fastening means 164 can enables rotation of the cutting blades 174 for drilling through sand, rocks, and debris, without switching the milling unit. The toothed ring 170 is compatible with components of the bridge plug system 100 or even pieces of those components. The protrusions 172 can be engaged to transfer any rotation of the milling unit in order to generate the rotation of the cutting blades 174. Additionally, as in FIG. 5, the adjacent interlocking drill means 330 of the adjacent bridge plug 300 is insertable over the shearing groove 154, so as to lock the adjacent bridge plug 300 to the interlocking means 190. In FIG. 8, the inner chamber 178 is friction fit to the another adjacent interlocking means 490 of the another adjacent bridge plug system 400 so as to lock rotation of the interlocking drill means 130 relative to the another adjacent bridge plug system 400 below the inner chamber 178 and to house the another adjacent shearing groove 454 of the another adjacent bridge plug system 400, after a respective upper end of the another adjacent bridge plug system 400 is sheared. The interlocking drill means 130 and interlocking means 190 remain modular and interchangeable so that the system 100 is identical and compatible with other systems. The terminology of the modular bridge plug system may include primary and secondary bridge plugs, which are adjacent to each other. Facing end to end, the primary and secondary bridge plugs can be locked together.

The method of connecting two bridge plugs, according to an embodiment of the present invention, includes aligning a primary bridge plug and a secondary bridge plug. In one example, the secondary bridge plug is positioned below the primary bridge plug. Being modular, the method will also work with the primary bridge plug below the secondary bridge plug. In whichever alignment, the secondary interlocking means is inserted and locked into the primary interlocking drill means or the primary interlocking means is inserted and locked into the secondary interlocking drill means.

The method includes rotating the primary interlocking drill means when at least a portion of the primary bridge plug moves toward the secondary bridge plug so as to drill towards the secondary bridge plug. At least a portion means that the primary bridge plug is being milled and destroyed, so there may not be a complete primary bridge plug. There may only be components or pieces of components remaining to move toward the secondary bridge plug. Additionally, the rotating primary interlocking drill means drills through sand, those pieces of the primary bridge plug fallen down the wellbore, and other debris in order to reach the secondary bridge plug. In particular, the primary interlocking drill means can reach the secondary interlocking means of the secondary bridge plug. Then, the method includes inserting the secondary interlocking means into the aligned primary interlocking drill means. The primary interlocking drill means locks to the secondary interlocking means to stop rotation of the primary interlocking drill means and to hold the bridge plugs together. The structures are modular and interchangeable with other respective bridge plug parts.

Embodiments of the method of the present invention includes separating the primary upper end from the primary interlocking means at the primary shearing groove to set the primary bridge plug, and separating the secondary upper end from the secondary interlocking means at the secondary shearing groove to set the secondary bridge plug. In embodiments with the primary shearing means being comprised of a primary shaft member having an upper end and a lower end, and a primary shearing groove between the upper end and the lower end, the primary interlocking means is positioned on the lower end of the primary shaft member and between the primary shearing groove and the lower portion of the primary mandrel. Setting the primary bridge plug includes shearing that upper end, so that the remnants are the primary shearing groove and the primary interlocking means, which are ready for an adjacent interlocking drill means. Similarly, the secondary shearing means can be comprised of a secondary shaft member having an upper end and a lower end, and a secondary shearing groove between the upper end and the lower end. The secondary interlocking means is positioned on the lower end of the secondary shaft member and between the secondary shearing groove and the lower portion of the secondary mandrel. Setting the secondary bridge plug includes shearing that upper end, so that the remnants are the secondary shearing groove and the secondary interlocking means, which are ready for the primary interlocking drill means.

In another embodiment, the primary interlocking drill means comprises: a primary tubular body with a forward end and a back end; a primary fastening means on the back end; and a primary drilling means on the forward end. The primary tubular body has a primary inner chamber adjacent the back end between the primary fastening means and the primary drilling means. Furthermore, the primary drilling means comprises: a primary plurality of cutting blades around a primary perimeter of the forward end, the cutting blades facing away from the primary mandrel; a primary inner cavity formed by the cutting blades; and a primary transition zone between the inner cavity and the inner chamber. As such, the step of rotating the primary interlocking drill means, further comprises the steps of: deploying a milling unit into the wellbore; milling the primary bridge plug; and engaging the milling unit to the primary fastening means of the primary bridge plug, wherein rotation of the primary interlocking drilling means corresponds to rotation of the milling unit. The respective components of the primary interlocking drill means drill through the wellbore with the primary cutting blades, wherein rotation of the primary cutting blades corresponds to rotation of the milling unit. The rotation is not exactly the same, but whatever rotation imparted through the toothed ring causes the drilling by the cutting blades.

The cutting blades will eventually reach the secondary bridge plug through the sand, rocks, and debris. Thus, the step of inserting can further include inserting at least a portion of the secondary shearing means, such as a portion of the secondary shearing groove, through the primary inner chamber, through the primary transition zone, and to the primary inner cavity. The secondary interlocking means guided through the primary interlocking drill means to be held within the primary inner chamber. The rotation of the primary cutting blades stop. The primary interlocking drill means is trapped between the metal and composite of the secondary bridge plug and the milling unit. Now, the milling unit can continue milling any remaining portions of the primary bridge plug and the primary interlocking drill means itself. Once removed, the milling unit can mill the secondary bridge plug. The method can be repeated with the secondary interlocking drill means rotating when at least a portion of the secondary bridge plug moves toward an adjacent bridge plug. The secondary interlocking drill means can drill towards the next bridge plug down the wellbore.

The millable bridge plug system of the present invention has a drilling end. The cutting blades for sand, rocks and debris enables the milling unit to reach the next bridge plug quickly and efficiently. The milling unit for composite and metal does not need to be replaced or substituted for cutters of a drill bit. The bridge plug system of the present invention provides the cutting blades compatible with imparted rotation from the milling unit. The milling unit does not have to switch cutters or change configurations. The parts of the bridge plug can be used and then disposed. The present invention also provides for an interlocking drill end. The toothed ring allows for imparting rotation of the milling unit to the cutting blades. The inner chamber allows for a modular locking connection to an adjacent bridge plug. The structures support interlocking the bridge plug being milled and the bridge plug to be milled. Additionally, the ends interchangeably connect with adjacent bridge so as to be modular and compatible with any bridge plug further along the wellbore.

The foregoing disclosure and description of the invention is illustrative and explanatory thereof. Various changes in the details of the illustrated structures, construction and method can be made without departing from the true spirit of the invention.

We claim:

1. A millable bridge plug system, comprising:

a mandrel having an upper portion and a lower portion, said mandrel being comprised of a shearing means attached at said upper portion of said mandrel, and an interlocking means between said shearing means and said lower portion;

a sealing means positioned around the mandrel between said upper portion and said lower portion;

a plurality of ring members, a first ring member adjacent an upper end of said sealing means and a second ring member adjacent a lower end of said sealing means;

a plurality of cone assemblies, a first cone assembly proximate to said first ring member and a second cone assembly proximate to said second ring member, said first ring member being between said first cone assembly and said sealing means, said second ring member being between said second cone assembly and said sealing means;

a plurality of slip means for extending radially outward and engaging an inner surface of a surrounding borehole, a first slip means mounted around said mandrel and engaging said first cone assembly and a second slip means mounted around said mandrel and engaging said second cone assembly; and an interlocking drill means attached at said lower portion of said mandrel, wherein said shearing means comprises a shaft member having an upper end and a lower end and a shearing groove between said upper end and said lower end, said interlocking means on said lower end of said shaft and between said shearing groove and said lower portion, wherein said interlocking drill means comprises:

a tubular body with a forward end and a back end;

a fastening means on said back end; and a drilling means on said forward end, said forward end facing away from said lower portion of said mandrel, said back end facing toward said second slip means, said tubular body having an inner chamber adjacent said back end between said fastening means and said drilling means, wherein said fastening means is comprised of a toothed ring having at least two protrusions extending toward said second slip means, wherein said drilling means comprises:

a plurality of cutting blades around a perimeter of said forward end, said cutting blades facing away from said mandrel; and an inner cavity formed by said cutting blades; and a transition zone between said inner cavity and said inner chamber, and wherein said inner cavity is complementary to an adjacent interlocking means of an adjacent mandrel so as to lock said drilling means relative to said adjacent mandrel.

2. The bridge plug system, according to claim 1, wherein a diameter of said inner cavity narrows to a diameter of said inner chamber in said transition zone.

3. The bridge plug system, according to claim 1, wherein said interlocking means is comprised of flattened outer surfaces on opposite sides of said mandrel, and wherein said inner chamber is comprised of complementary flattened inner surfaces on opposite sides of said drilling means.

4. The bridge plug system, according to claim 3, wherein said interlocking means is friction fit to an adjacent inner chamber of an adjacent bridge plug system so as to lock rotation of said adjacent bridge plug system relative to said interlocking means.

5. The bridge plug system, according to claim 4, wherein said shearing groove fits within said adjacent inner chamber of said adjacent bridge plug system.

6. The bridge plug system, according to claim 5, wherein said interlocking means is friction fit to said adjacent inner chamber of said adjacent bridge plug system so as to lock rotation of said adjacent inner chamber relative to said interlocking means and to house said shearing groove within said adjacent inner chamber of said adjacent bridge plug system above said interlocking means, after said upper end of said shaft is sheared.

7. The bridge plug system, according to claim 3, wherein said inner chamber is friction fit to another adjacent interlocking means of another adjacent bridge plug system so as to lock rotation of said interlocking drill means relative to said another adjacent bridge plug system.

8. The bridge plug system, according to claim 7, wherein said inner chamber fits another adjacent shearing groove of said another adjacent bridge plug system within said inner chamber.

9. The bridge plug system, according to claim 8, wherein said inner chamber is friction fit to said another adjacent interlocking means of said another adjacent bridge plug system so as to lock rotation of said interlocking drill means relative to said another adjacent bridge plug system below said inner chamber and to house said another adjacent shearing groove of said another adjacent bridge plug system, after a respective upper end of said another adjacent bridge plug system is sheared.

10. The bridge plug system, according to claim 1, wherein said cutting blades are equally distributed along said perimeter.

* * * * *